US006220374B1

(12) United States Patent
Crawford

(10) Patent No.: US 6,220,374 B1
(45) **Date of Patent: *Apr. 24, 2001**

(54) ROTARY CONE DRILL BIT WITH ENHANCED THRUST BEARING FLANGE

(75) Inventor: Micheal B. Crawford, Duncanville, TX (US)

(73) Assignee: Dresser Industries, Inc., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,127

(22) Filed: Jan. 25, 1999

Related U.S. Application Data

(60) Provisional application No. 60/072,488, filed on Jan. 26, 1998.

(51) Int. Cl.[7] ..... E21B 10/22

(52) U.S. Cl. ..... 175/372; 384/95

(58) Field of Search ..... 384/92, 94, 95, 384/96; 175/371, 372

(56) References Cited

U.S. PATENT DOCUMENTS

| | | | | |
|---|---|---|---|---|
| 2,214,221 | | 9/1940 | Catland | 308/198 |
| 2,329,751 | * | 9/1943 | Fermier | 175/371 |
| 2,339,161 | | 1/1944 | Fermier | 308/9 |
| 3,476,446 | | 11/1969 | Neilson | 308/8.2 |
| 3,823,030 | | 7/1974 | Hudson | 117/131 |
| 3,866,987 | * | 2/1975 | Garner | 308/8.2 |
| 3,952,815 | | 4/1976 | Dysart | 175/374 |
| 4,054,772 | | 10/1977 | Lichte | 219/121 |
| 4,056,153 | | 11/1977 | Miglierini | 175/376 |
| 4,120,543 | | 10/1978 | Greene, Jr. et al. | 308/233 |
| 4,194,794 | | 3/1980 | Kling | 308/3.8 |
| 4,280,571 | | 7/1981 | Fuller | 175/337 |
| 4,304,444 | | 12/1981 | Persson | 308/8.2 |
| 4,562,892 | * | 1/1986 | Ecer | 175/371 |
| 5,439,068 | | 8/1995 | Huffstutler et al. | 175/356 |
| 5,456,327 | * | 10/1995 | Denton et al. | 175/371 |
| 5,513,713 | | 5/1996 | Groves | 175/73 |
| 5,513,715 | | 5/1996 | Dysart | 175/371 |
| 5,570,750 | | 11/1996 | Williams | 175/371 |
| 5,593,231 | | 1/1997 | Ippolito | 384/114 |
| 5,642,942 | | 7/1997 | Wagoner | 384/95 |
| 5,794,726 | * | 8/1998 | McDowell | 175/371 |
| 6,053,264 | * | 4/2000 | Frankel et al. | 175/371 |
| B1 5,439,067 | | 3/1997 | Huffstutler | 175/339 |

OTHER PUBLICATIONS

"Roller Bits," Sandvik Coromant Rock Drilling Tools User's Handbook, *Sandvik Rock Tools*, HR–12820–ENG, 1994.

"Baker Hughes Mining Tools Product Catalog," *Baker Hughes Mining Tools* © 1991.

* cited by examiner

*Primary Examiner*—David Bagnell
*Assistant Examiner*—Zakiya Walker
(74) *Attorney, Agent, or Firm*—Groover & Associates; Robert Groover; Betty Formby

(57) ABSTRACT

The present invention allows the load-bearing capabilities of a drill bit thrust flange to be increased. The invention utilizes a thrust flange that is larger than the inside diameter of an associated drill bit journal bushing. The thrust flange may extend past the inside diameter of the journal bushing up to a distance equal to two times the thickness of the journal bushing. The invention may also utilize a thrust washer that is disposed adjacent the thrust flange to assist in bearing loads applied to the thrust flange.

27 Claims, 5 Drawing Sheets

ROTARY CONE DRILL BIT WITH ENHANCED THRUST BEARING FLANGE

RELATED APPLICATIONS

This application claims the benefit of previously filed provisional application U.S. Ser. No. 60/072,488, filed Jan. 26, 1998, entitled Rotary Cone Drill Bit with Enhanced Thrust Bearing Flange.

This application is related to co-pending application U.S. Ser. No. 09/237,133, filed Jan. 25, 1999, entitled Rotary Cone Drill Bit with Enhanced Journal Bushing.

TECHNICAL FIELD OF THE INVENTION

The present invention relates generally to rotary cone drill bits and more specifically to a rotary cone drill bit with an enhanced thrust bearing flange.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper portion adapted for connection to a drill string. A plurality of support arms, typically three, depend from the lower portion of the bit body with each support arm having a spindle or journal protruding radially inward and downward with respect to a projected rotational axis of the bit body.

A cutter cone assembly is generally mounted on each spindle or journal. Each cutter cone typically has a opening at its base, and a cavity extending from the base almost to the tip of the cutter cone. The cavity is formed such that it conforms with the associated journal. The cutter cone is supported rotatably on bearings acting between the exterior of the journal and the interior of the cutter cone assembly. The bearings in a typical rotary cone drill bit are heavily loaded during downhole drilling operations. In such drilling operations, the drill bit is rotated in a borehole, which causes the associate cutter cone assemblies to rotate on their respective journals. The drill bit typically operates at a low speed with heavy weight applied to the bit. This produces a high load on the associated bearings.

The drill bit typically includes a journal bushing. The journal bushing is positioned around the journal, and between the journal and the cutter cone assembly. The journal bushing is used to bear some of the forces transmitted between the journal and the cutter cone assembly, and to facilitate the rotation of the cutter cone assembly about the journal.

The journal also typically includes a thrust flange. The top of the thrust flange typically bears the load applied to the journal that is generally parallel to the axis of the journal about which the cutter cone rotates. Such forces are applied to the journal by the cutter cone assembly, and to the cutter cone assembly by the borehole wall. A thrust washer or bushing may be placed between the thrust flange and the cutter cone assembly to help bear this load. In addition, the thrust flange may also be used to contain the ball bearings. In such a situation, the thrust flange also must bear the load applied by the ball bearings when forces are acting to pull the cutter cone assembly off of its respective journal.

SUMMARY OF THE INVENTION

In accordance with teachings of the present invention, a roller cone drill bit having support arms with a spindle or journal extending from each support arm, and a respective cutter cone assembly rotatably mounted thereon is provided with an improved thrust flange.

The present invention allows the load-bearing capabilities of a drill bit thrust flange to be increased. The invention utilizes an enhanced thrust flange that is larger than the inside diameter of an associated drill bit journal bushing. The thrust flange may extend past the inside diameter of the journal bushing up to a distance equal to two times the thickness of the journal bushing. The invention may also utilize a thrust washer that is disposed adjacent the thrust flange to assist in bearing loads applied to the thrust flange.

Technical advantages of the present invention include an increased load carrying capacity of the thrust flange. This increased capacity improves the performance of the drill bit, and increases the drill bit's useful life by reducing the unit loading on its load-bearing surfaces. Another technical advantage of the present invention is that the enhanced thrust flange aids in maintaining the axis of the cutter cone concentric with the axis of the journal. This decreases wear on the drill bit, and thus increases its useful life.

Other technical advantages will be readily apparent to one skilled in the art from the following figures, descriptions, and claims.

BRIEF DESCRIPTION OF THE DRAWINGS

For a more complete understanding of the present invention and its advantages, reference is now made to the following brief description, taken in conjunction with the accompanying drawings and detailed description, wherein like reference numerals represent like parts, in which.

DETAILED DESCRIPTION OF THE INVENTION

The preferred embodiments of the present invention and its advantages are best understood by referring now in more detail to FIGS. 1–6 of the drawings, in which like numerals refer to like parts.

Figure 1:
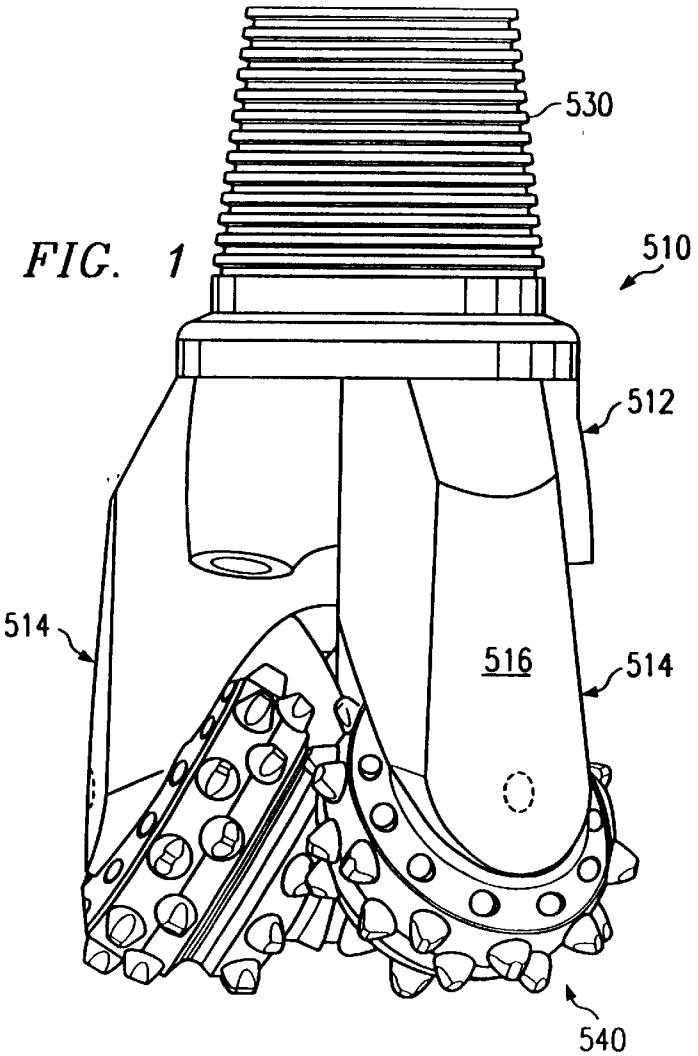
FIG. 1 is a schematic drawing in elevation showing one type of rotary cone drill bit with support arms that may be used in conjunction with cutter cone assemblies formed in accordance with teachings of the present invention.

FIG. 1 illustrates various aspects of a rotary cone drill bit indicated generally at 510 of the type used in drilling a borehole in the earth. Drill bit 510 may also be referred to as a "roller cone rock bit" or "rotary rock bit." With rotary cone drill bit 510, cutting action occurs as cone-shaped cutters, indicated generally at 540, are rolled around the bottom of a borehole (not expressly shown) by the rotation of a drill string (not expressly shown) attached to drill bit 510. Cutter cone assemblies 540 may also be referred to as "rotary cone cutters" or "roller cone cutters." Cutter cone assemblies 540 may be modified so that they may be used in conjunction with the present invention, as described below in conjunction with FIG. 4.

Rotary cone drill bit 510 includes bit body 512 having a tapered, externally threaded upper portion 530 which is adapted to be secured to the lower end of a drill string. Depending from body 512 are three support arms 514. Only two support arms 514 are visible in FIG. 1. Each support arm 514 preferably includes a spindle or journal (not explicitly shown) formed integral with the respective support arm 514. Each cutter cone assembly 540 is rotatably mounted on a respective journal. The journals are preferably angled downwardly and inwardly with respect to bit body 512 and exterior surface 516 of the respective support arm 514. As drill bit 510 is rotated, cutter cone assemblies 540 engage the bottom of the borehole. For some applications, the journals may also be tilted at an angle of zero to three or four degrees in the direction of rotation of drill bit 510.

Figure 2:
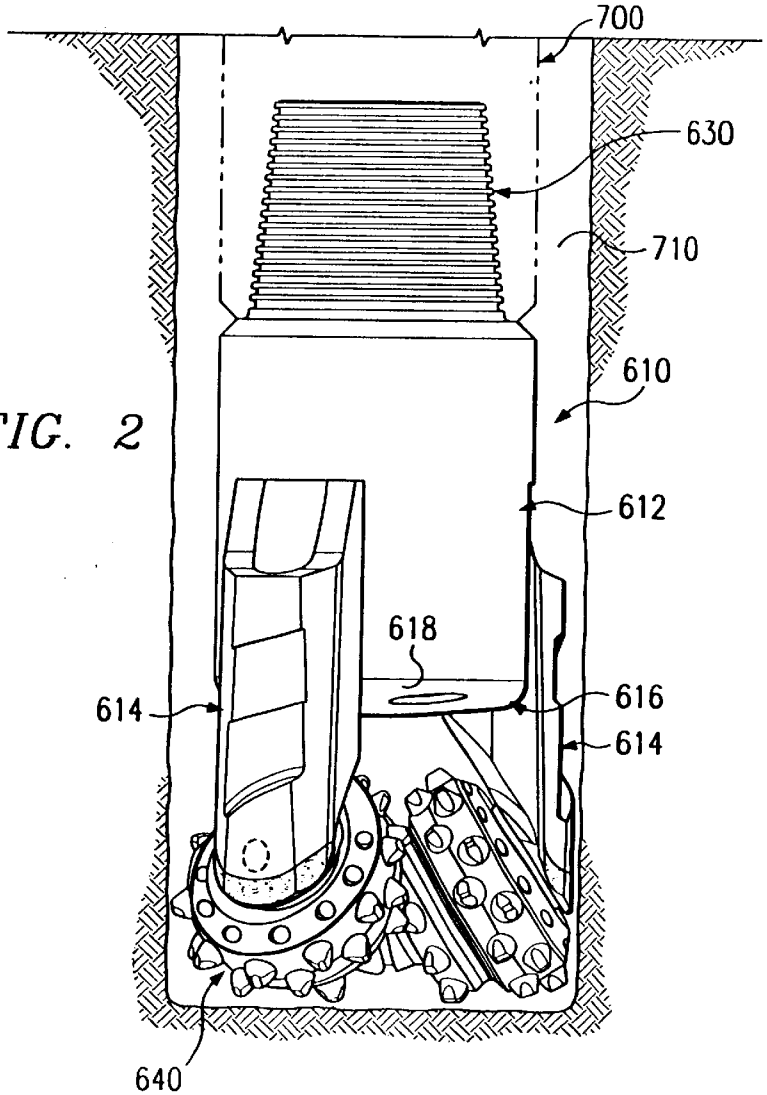
FIG. 2 is a schematic drawing in section and in elevation with portions broken away showing another type of rotary cone drill bit disposed at a downhole location in a borehole with the drill bit having support arms that may be used in conjunction with cutter cone assemblies formed in accordance with teachings of the present invention.

FIG. 2 is an isometric drawing of a rotary cone drill bit, indicated generally at 610, attached to a drill string 700 and disposed in borehole 710. Examples of such drill bits and their associated bit body, support arms and cutter cone assemblies are shown in U.S. Pat. No. 5,439,067 entitled Rock Bit With Enhanced Fluid Return Area, and U.S. Pat. No. 5,439,068 entitled Modular Rotary Drill Bit. These patents provide additional information concerning the manufacture and assembly of unitary bit bodies, support arms and cutter cone assemblies which are satisfactory for use with the present invention.

Drill bit 610 includes one piece or unitary body 612 with upper portion 630 having a threaded connection adapted to secure drill bit 610 with the lower end of drill string 700. Three support arms 614 are preferably attached to and extend longitudinally from bit body 612 opposite from upper portion 630. Only two support arms 614 are shown in FIG. 2. Each support arm 614 preferably includes a respective cutter cone assembly 640. Cutter cone assemblies 640 extend generally downwardly and inwardly from respective support arms 614. Cutter cone assemblies 640 may be modified so that they may be used in conjunction with the present invention, as described below in conjunction with FIG. 4.

Bit body 612 includes lower portion 616 having a generally convex exterior surface 618 formed thereon. The dimensions of convex surface 618 and the location of cutter cone assemblies 640 are selected to optimize fluid flow between lower portion 616 of bit body 612 and cutter cone assemblies 640. The location of each cutter cone assembly 640 relative to lower portion 616 may be varied by adjusting the length of support arms 614 and the spacing of support arms 614 on the exterior of bit body 612.

Figure 3:
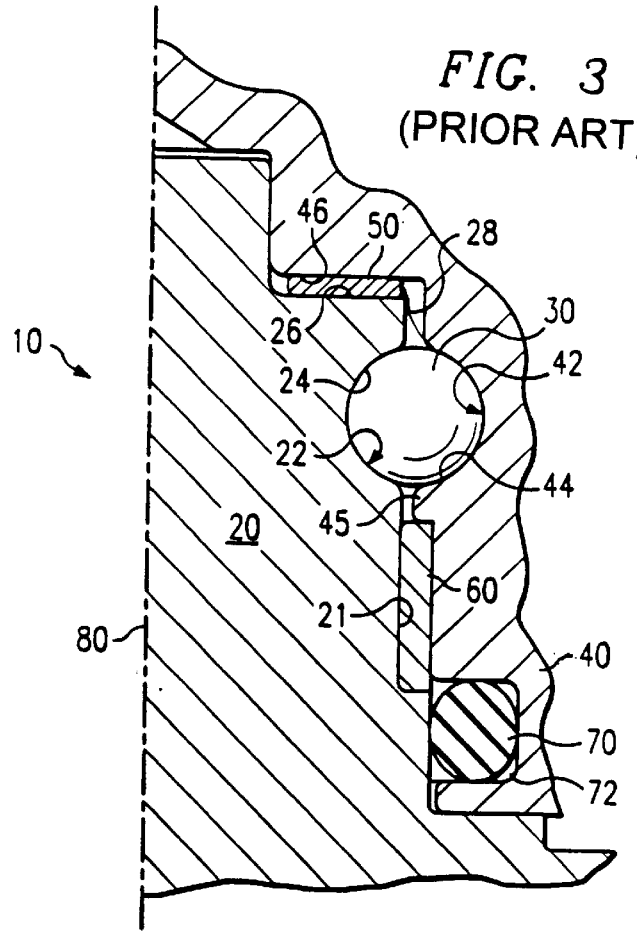
FIG. 3 (PRIOR ART)
FIG. 3 is a schematic drawing in section with portions broken away showing portions of a typical rotary cone drill bit having a support arm with a journal extending therefrom, and showing a cutter cone assembly rotatably mounted on the journal.

Referring now to FIG. 3, a schematic drawing shows portions of a typical rotary cone drill bit 10 having a support arm with a journal or spindle 20 extending therefrom, and showing a cutter cone assembly 40 rotatably mounted on journal 20. Journal 20 fits within a cavity formed in cutter cone 40, and is mounted such that it may rotate about the longitudinal axis 80 of journal 20.

A series of ball bearings 30 are disposed between journal 20 and cutter cone 40 to hold cutter cone 40 onto journal 20, and to facilitate rotation of cutter cone 40 about journal 20. Ball bearings 30 are positioned between an arm ball race 22 formed in journal 20 and a cone ball race 42 formed in cutter cone 40. Arm ball race 22 and cone ball race 42 are both annular grooves. The radius of cone ball race 42 is typically closer to the ball bearing radius than the radius of arm ball race 22. With such a configuration, arm ball race 22 is primarily loaded along a surface 24. Surface 24 is approximately the top half of arm ball race 22, as shown in FIG. 3. Any forces that tend to pull cutter cone 40 off journal 20 are taken up by journal 20 along surface 24.

The portion of journal 20 that extends over ball bearings 30 is a thrust flange 28. Thrust surface 26 of thrust flange 28 aids in bearing the load placed on journal 20 by surface 46 of cutter cone 40. In the prior art, the diameter of thrust flange 28 typically extends no further than the diameter of a journal bearing surface 21 of journal 20. A thrust washer or bushing 50 may be positioned between thrust surface 26 of thrust flange 28 and surface 46 of cone 40. The outside diameter of thrust washer 50 may be larger than the diameter of thrust flange 28. Alternatively, surface 26 of thrust flange 28 may directly contact surface 46. This is typically referred to as "flange contact."

A journal bushing 60 is positioned between journal 20 and cone 40. In the prior art, the inside diameter of bushing 60 is generally equal to or greater than the outside diameter of thrust washer 50 and the diameter of thrust flange 28. Journal bushing 60 is separated from ball bearing 30 by a bearing flange 45. Bearing flange 45 prevents the movement of journal bushing 60 towards ball bearings 30. Drill bit 10 also includes a elastomeric seal 70 that is used to prevent debris from entering the gap between journal 20 and cone 40. Seal 70 is disposed in an annular groove 72 formed in the interior surface of cutter cone 40.

The present invention teaches extending thrust flange 28 out past journal bearing surface 21 in order to increase the support for thrust washer 50 and/or surface 46 of cutter cone 40. Journal bushing 60 and elastomeric seal 70 will remain substantially the same as shown in FIG. 3. In addition, the same ball bearings 30 may be used. A portion of a rotary cone drill bit 110 incorporating teachings of the present invention is shown in FIG. 4.

Figure 4:
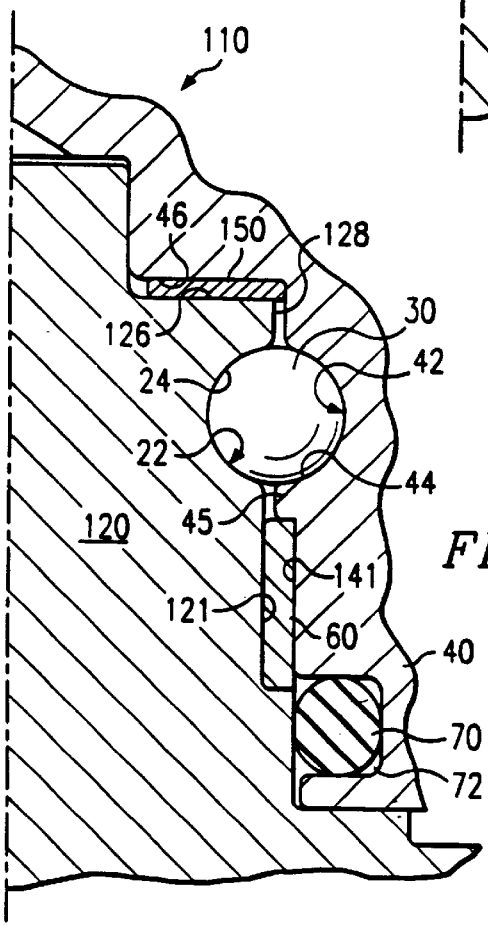
FIG. 4 is a schematic drawing in section with portions broken away of a rotary cone drill bit support arm having a journal extending therefrom with an enhanced thrust flange formed adjacent to one end of the journal, and with a cutter cone assembly rotatably mounted on journal.
Figure 5:
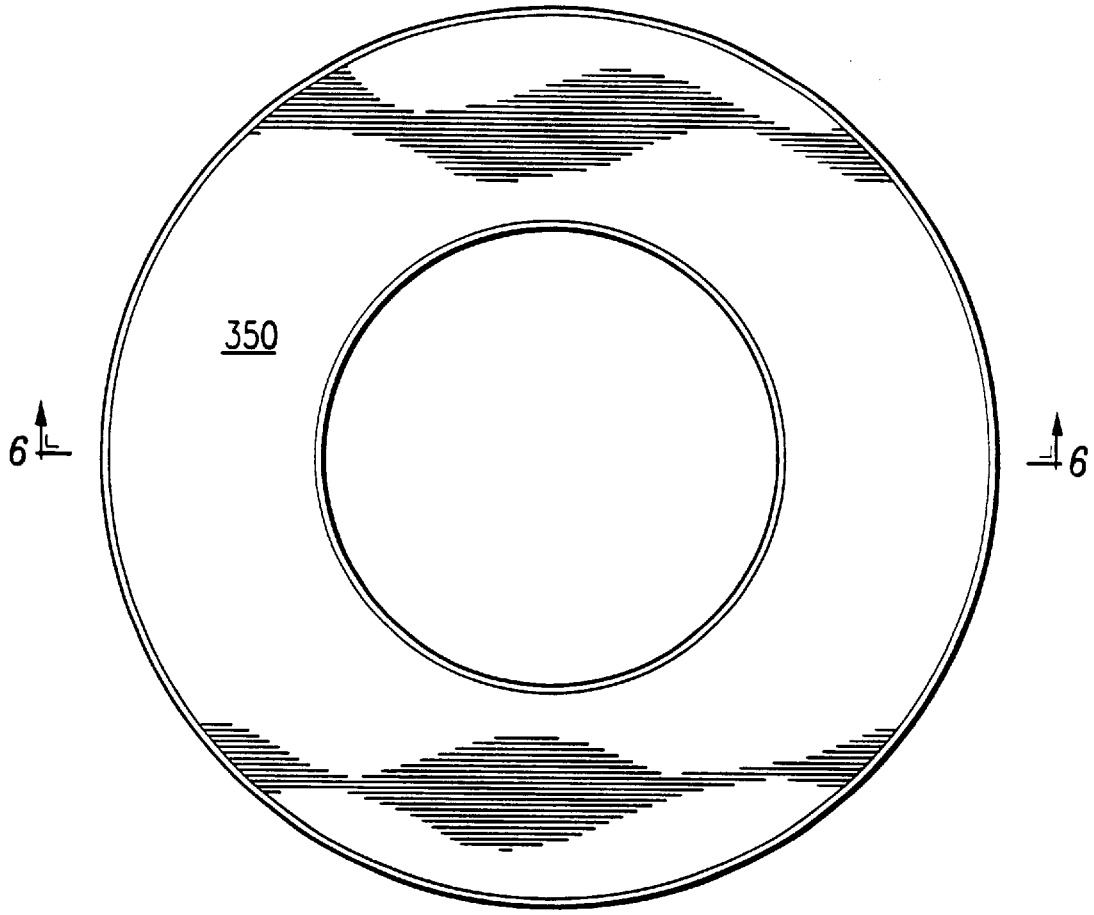
FIG. 5 is a schematic drawing showing a plan view of a thrust washer which may be satisfactorily used in conjunction with the present invention.
Figure 6:
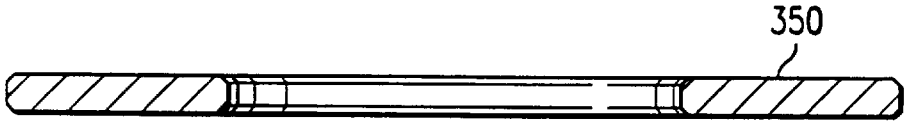
FIG. 6 is a drawing in section taken along lines 6—6 of FIG. 5.

Referring now to FIG. 4, journal 120 includes an enhanced thrust flange 128 having a diameter larger than the diameter of thrust flange 28 of FIG. 3. The increased diameter of thrust flange 128 is larger than the diameter of journal 120 at a journal bearing surface 121. In addition, because of the increased diameter of thrust flange 128, thrust washer 150 may be larger than thrust washer 50 of FIG. 3, and have more support from the enlarged thrust surface 126 of thrust flange 128. For example, the outside diameter of thrust washer 150 may be approximately equal to the inside diameter of cutter cone 40 adjacent thrust washer 150, as shown in FIG. 4. One example of a thrust washer 350 suitable for use with the present invention is shown in FIGS. 5 and 6.

Utilizing a larger thrust washer 150 and a larger thrust flange 128 increases the area of contact between journal 120 and cutter cone 40, thus reducing the unit loading on the interface of surfaces 46 and 126. The size of surface 24 is also increased, thus decreasing the unit loading on the interface of thrust flange 128 and ball bearings 30. The extension of thrust flange 128 also improves the stability of cutter cone 40 by helping to prevent the rocking or wobbling of cutter cone 40 on journal 120. By decreasing the unit loading and increasing the stability of drill bit 110, better performance is obtained from drill bit 110.

In one embodiment of the present invention, the diameter of thrust flange 128 may be 0.100 inches larger than the outside diameter of journal 120 at journal bearing surface 121. However, other appropriate dimensions may be utilized, and such dimensions will vary depending on the overall size of the drill bit. One limiting factor for the diameter of thrust flange 128 will be the inside diameter of cutter cone 40 adjacent thrust flange 128.

Figure 7:
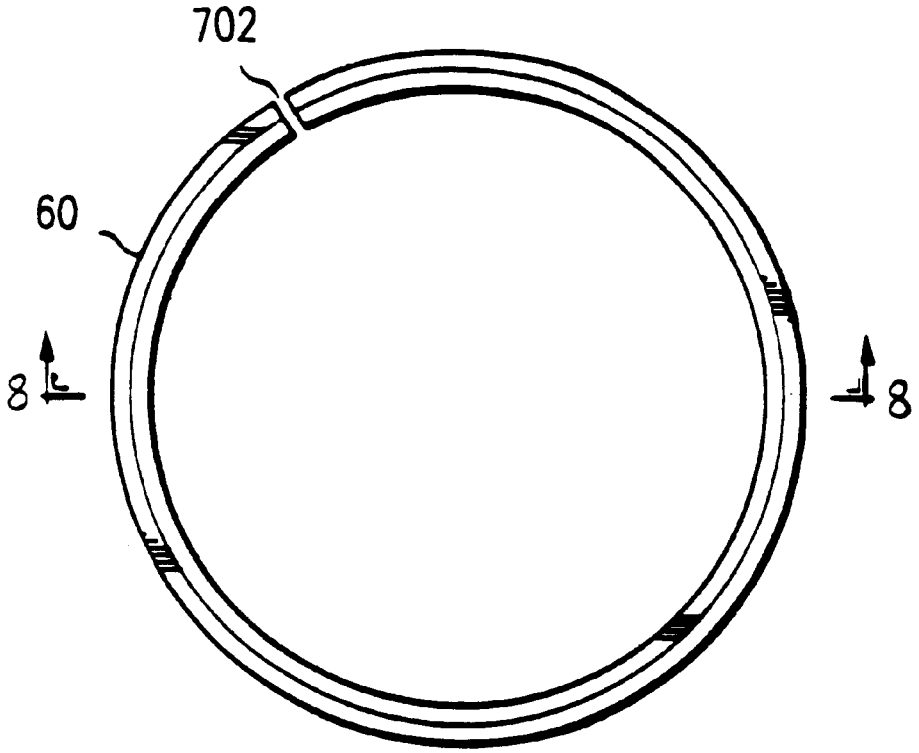
FIG. 7 shows a journal bushing including a split to aid in placement over the journal.

FIG. 7 is a schematic drawing showing a journal bushing 60. Journal bushing 60 may be split at point 702. Such a split is made to allow the expansion of journal bushing 60 for placement around a journal.

Figure 8:
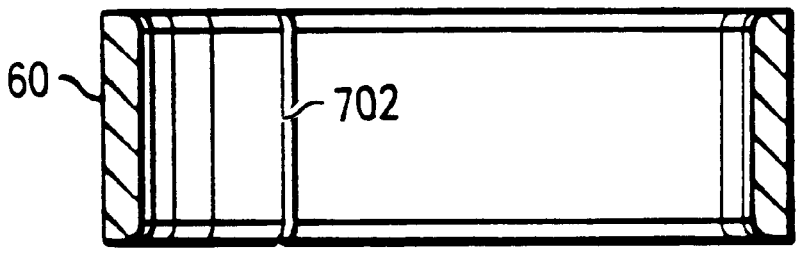
FIG. 8 shows a section taken along lines 8—8 of FIG. 7.

FIG. 8 shows a cross section of FIG. 7 along lines 8—8.

Figure 9:
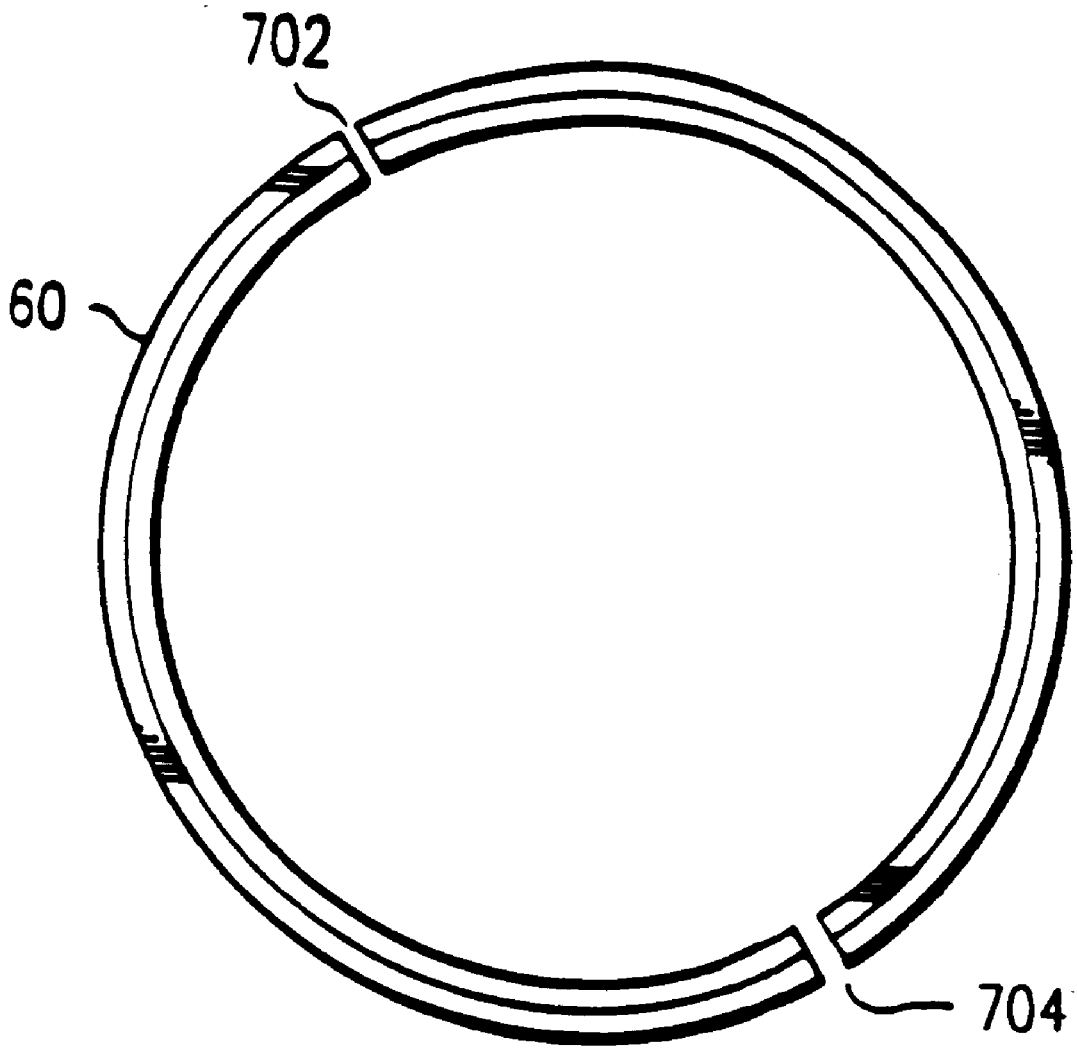
FIG. 9 shows a journal bushing comprising two semicircle halves.

For some applications, it may be desirable to have a two-piece journal bushing, as shown in FIG. 9. As shown, this embodiment includes a second split 704 located approximately opposite first split 702. Such a configuration is particularly useful when the journal bushing is made out of material that is not flexible or does not return to its desired shape after being placed around the journal.

Although the present invention has been described by several embodiments, various changes and modifications may be suggested to one skilled in the art. It is intended that the present invention encompasses such changes and modifications as fall within the scope of the present appended claims.

What is claimed is:

1. A rotary cone drill bit for forming a bore hole, the drill bit comprising:

a bit body having an upper portion adapted for connection to a drill string for rotation about a longitudinal axis of the bit body;

a number of angularly spaced support arms extending from the bit body with each support arm having an inside surface with a journal connected thereto;

each journal projecting generally downwardly and inwardly with respect to the axis of rotation for the bid body;

each journal having a generally cylindrical configuration with a first end connected to the inside surface of the respective support arm and a second end extending from the indside surface of the respective suport arm;

a plurality of cutter cone assemblies equal to the number of support arms with each cutter cone assembly rotatably mounted on one of the journals;

each cutter cone assembly having an opening with a cavity extending therefrom and sized to receive the respective journal therein such that a gap is formed between the exterior of each journal and the interior surface of the respective cutter cone assembly defined by the cavity;

a first annular groove formed in the exterior of each journal intermediate the first end and the second end;

a second annular groove formed in the interior of each cutter cone assembly adjacent to the first annular groove of the journal;

a plurality of ball bearings disposed within the first annular groove and the second annular groove to rotatably secure each cutter cone assembly to its respective journal;

a thrust flange formed on the exterior of each journal intermediate the first annular groove and the second end of the journal;

a journal bearing surface formed on the exterior of each journal intermediate the first annular groove and the first end of the respective journal;

the thrust flange of each journal having a first diameter and the journal bearing surface of each journal having a second diameter;

a thrust washer disposed around the journal and between a thrust surface of the thrust flange and the interior surface of the cutter cone assembly;

wherein the thrust washer has an outside diameter larger than the first diameter of the thrust flange.

2. The rotary cone drill bit of claim 1 wherein the thrust washer has an outside diameter generally equal to the inside diameter of the cutter cone assembly adjacent the thrust washer.

3. The rotary cone drill bit of claim 1 further comprising a journal bushing positioned around each journal such that the journal bushing contacts the journal bearing surface.

4. The rotary cone drill bit of claim 3 wherein the journal bushing is formed with a slit along one side to allow for expansion of the journal bushing around the thrust flange during positioning of the journal bushing around each journal.

5. The rotary cone drill bit of claim 3 wherein the journal bushing comprises a first and second generally semi-circular halves, each half formed such that it fits around approximately one-half of the outer circumference of the journal bearing surface.

6. The rotary cone drill bit of claim 1 wherein the first diameter of the thrust bearing flange is larger than the second diameter of the journal bearing surface.

7. The rotary cone drill bit of claim 1 wherein the thrust washer has an outside diameter larger than the second diameter of the journal bearing surface.

8. A support arm-cutter assembly for a rotary cone drill bit comprising:

a support arm having an inside surface;

a journal attached to the inside surface and angled downwardly with respect to the support arm;

a cutter cone assembly having a body with an opening for receiving the journal and a cavity extending from the opening defining an interior surface of the cavity;

the body formed by a base portion with a tip joined thereto and extending therefrom;

a gap formed between the exterior of the journal and the interior surface of the cutter cone assembly;

a first annular groove formed in the exterior of the journal intermediate a first end and a second end of the journal;

a second annular groove formed in the interior of each cutter cone assembly adjacent the first annular groove of the journal;

a plurality of ball bearings disposed within the first annular groove and the second annular groove to rotatably secure the cutter cone assembly on the journal;

a thrust flange formed on the exterior of the journal intermediate the first annular groove and the second end of the journal;

a journal bearing surface formed on the exterior of the journal intermediate the first annular groove and the first end of the journal;

the thrust flange of the journal having a first diameter and the journal bearing surface of the journal having a second diameter;

a thrust washer disposed around the journal and between a thrust surface of the thrust flange and the interior surface of the cutter cone assembly;

wherein the thrust washer has an outside diameter larger than the first diameter of the thrust flange.

9. The support arm-cutter assembly of claim 8 wherein the thrust washer has an outside diameter generally equal to the inside diameter of the cutter come assembly adjacent the thrust washer.

10. The support arm-cutter assembly of claim 8 further comprising a journal bushing positioned around the journal such that it contacts the journal bearing surface.

11. The support arm-cutter of claim 10 wherein the journal bushing is formed with a slot along one side to allow for expansion of the journal bushing around the thrust flange during positioning of the journal bushing around the journal.

12. The support arm-cutter assembly of claim 10 wherein the journal bushing comprises a first and second generally semi-circular halves, each half formed such that it fits around approximately one-half of the outer circumference of the journal bearing surface.

13. The support arm-cutter assembly of claim 8 wherein the first diameter of the thrust bearing flange is larger than the second diameter of the journal bearing surface.

14. The support arm-cutter assembly of claim 8 wherein the thrust washer has an outside diameter larger than the second diameter of the journal bearing surface.

15. A journal for a rotary cone drill bit, comprising:

a generally cylindrical body;

a first end for attachment to a support arm of the rotary cone drill bit;

a second end disposed opposite the first end;

a journal bearing surface formed on the exterior of the journal body intermediate the first and second ends;

a thrust flange formed on the exterior of the journal body intermediate the journal bearing surface and the second end;

the thrust flange having a first diameter and the journal bearing surface having a second diameter;

a thrust washer disposed on the exterior of the journal around the first diameter of the thrust flange;

wherein the thrust washer has an ouside diameter larger than the first diameter of the thrust flange.

16. The journal of claim 15 wherein the thrust washer has an outside diameter generally equal to the inside diameter of the cutter cone assembly adjacent the thrust washer.

17. The journal of claim 15 further comprising a journal bushing positioned around the journal such that it contacts the journal bearing surface.

18. The journal of claim 17 wherein the journal bushing is formed with a slit along one side to allow for expansion of the journal bushing around the thrust flange during positioning of the journal bushing around the journal.

19. The journal of claim 17 wherein the journal bushing comprises a first and second generally semi-circular halves, each half formed such that it fits around approximately one-half of the outer circumference of the journal bearing surface.

20. The journal of claim 15 wherein the first diameter of the thrust flange is larger than the second diameter of the journal bearing surface.

21. The journal of claim 15 wherein the thrust washer has an outside diameter larger than the second diameter of the journal bearing surface.

22. A roller cone drill bit, comprising:

a bit body having a connector by which said drill bit can be attached to a drill string;

a journal depending from said body, said journal having a thrust flange of a first diameter and a journal bearing surface of a second diameter;

a thrust washer positioned on a thrust surface of said thrust flange;

wherein said thrust washer has an outside diameter greater than said second diameter of said journal bearing surface.

23. The roller cone drill bit of claim 22, wherein said first diameter is greater than said second diameter.

24. The roller cone drill bit of claim 22, wherein said outside diameter of said thrust washer is generally equal to an inside diameter of a cutter cone mounted on said journal.

25. A roller cone drill bit, comprising:

a bit body configured for attachment to a drill string;

a journal depending from said body, said journal having a thrust flange of a first diameter and a journal bearing surface of a second diameter;

a roller cone rotatably mounted on said journal;

a thrust washer positioned between a thrust surface of said thrust flange and an inner surface of said roller cone;

wherein said thrust washer has an outside diameter greater than said second diameter of said journal bearing surface.

26. The roller cone drill bit of claim 25, wherein said first diameter is greater than said second diameter.

27. The roller cone drill bit of claim 25, wherein said outside diameter of said thrust washer is generally equal to an inside diameter of said roller cone.

* * * * *